US008259127B2

(12) United States Patent
Im et al.

(10) Patent No.: US 8,259,127 B2
(45) Date of Patent: Sep. 4, 2012

(54) SYSTEMS AND METHODS FOR REDUCING DESATURATION OF IMAGES RENDERED ON HIGH BRIGHTNESS DISPLAYS

(75) Inventors: MoonHwan Im, Cupertino, CA (US); Thomas Lloyd Credelle, Morgan Hill, CA (US)

(73) Assignee: Samsung Electronics Co., Ltd. (KR)

( * ) Notice: Subject to any disclaimer, the term of this patent is extended or adjusted under 35 U.S.C. 154(b) by 517 days.

(21) Appl. No.: 12/443,679

(22) PCT Filed: Sep. 25, 2007

(86) PCT No.: PCT/US2007/079408

§ 371 (c)(1),
(2), (4) Date: Mar. 30, 2009

(87) PCT Pub. No.: WO2008/039764

PCT Pub. Date: Apr. 3, 2008

(65) Prior Publication Data

US 2010/0026705 A1 Feb. 4, 2010

(51) Int. Cl.
*G09G 5/02* (2006.01)

(52) U.S. Cl. ..... 345/589; 345/617; 345/590; 345/82

(58) Field of Classification Search ..... 345/589
See application file for complete search history.

(56) References Cited

U.S. PATENT DOCUMENTS 4,439,759 A 3/1984 Fleming et al.
4,751,535 A 6/1988 Myers
4,946,259 A 8/1990 Matino et al.
4,989,079 A 1/1991 Ito
5,233,385 A 8/1993 Sampsell
5,311,295 A 5/1994 Tallman et al.
5,341,153 A 8/1994 Benzschawel et al.
5,398,066 A 3/1995 Martinez-Uriegas et al.
5,416,890 A 5/1995 Beretta
5,438,649 A 8/1995 Ruetz
5,448,652 A 9/1995 Vaidyanathan et al.
5,450,216 A 9/1995 Kasson
5,459,595 A 10/1995 Ishiguro (Continued)

FOREIGN PATENT DOCUMENTS

GB 2 282 928 A 4/1995

(Continued)

OTHER PUBLICATIONS

Baek-woon Lee, Keunkyu Song, Youngchol Yang, Cheolwoo Park, Joonhak Oh, Chongchul Chai, Jeongye Choi, Namseok Roh, Munpyo Hong, and Kyuha Chung. B.W , "Implementation of RGBW Color System in TFT-LCDs" SID Symposium Digest, vol. 34. pp. 111-113, 2004.*

(Continued)

*Primary Examiner* — Ulka Chauhan
*Assistant Examiner* — Sultana M Zalalee
(74) *Attorney, Agent, or Firm* — Innovation Counsel LLP

(57) ABSTRACT

In one embodiment of the display system, the display system comprises an image pipeline that accepts input color image data of one color gamut to be rendered on a display having high brightness subpixel layouts. In one embodiment, the system comprises a boost function that maps the input color data onto another color gamut that boosts the luminance of colors that might appear dark if rendered against a white or very light background.

8 Claims, 8 Drawing Sheets

U.S. PATENT DOCUMENTS

| | | | |
|---|---|---|---|
| 5,668,890 | A | 9/1997 | Winkelman |
| 5,694,186 | A | 12/1997 | Yanagawa et al. |
| 5,719,639 | A | 2/1998 | Imamura |
| 5,724,442 | A | 3/1998 | Ogatsu et al. |
| 5,731,818 | A | 3/1998 | Wan et al. |
| 5,821,913 | A | 10/1998 | Mamiya |
| 5,917,556 | A | 6/1999 | Katayama |
| 5,929,843 | A | 7/1999 | Tanioka |
| 5,933,253 | A | 8/1999 | Ito et al. |
| 5,937,089 | A | 8/1999 | Kobayashi |
| 5,949,496 | A | 9/1999 | Kim |
| 5,963,263 | A | 10/1999 | Shyu |
| 5,987,165 | A | 11/1999 | Matsuzaki et al. |
| 5,990,997 | A | 11/1999 | Jones et al. |
| 6,023,527 | A | 2/2000 | Narahara |
| 6,054,832 | A | 4/2000 | Kunzman et al. |
| 6,097,367 | A | 8/2000 | Kuriwaki et al. |
| 6,108,053 | A | 8/2000 | Pettitt et al. |
| 6,137,560 | A | 10/2000 | Utsumi et al. |
| 6,147,664 | A | 11/2000 | Hansen |
| 6,243,055 | B1 | 6/2001 | Fergason |
| 6,256,425 | B1 | 7/2001 | Kunzman |
| 6,262,710 | B1 | 7/2001 | Smith |
| 6,278,434 | B1 | 8/2001 | Hill et al. |
| 6,297,826 | B1 | 10/2001 | Semba et al. |
| 6,360,008 | B1 | 3/2002 | Suzuki et al. |
| 6,360,023 | B1 | 3/2002 | Betrisey et al. |
| 6,384,836 | B1 | 5/2002 | Naylor, Jr. et al. |
| 6,393,145 | B2 | 5/2002 | Betrisey et al. |
| 6,421,142 | B1 | 7/2002 | Lin et al. |
| 6,453,067 | B1 | 9/2002 | Morgan et al. |
| 6,459,419 | B1 | 10/2002 | Matsubayashi |
| 6,483,518 | B1 | 11/2002 | Perry et al. |
| 6,536,904 | B2 | 3/2003 | Kunzman |
| 6,614,414 | B2 | 9/2003 | De Haan et al. |
| 6,633,302 | B1 | 10/2003 | Ohsawa et al. |
| 6,707,463 | B1 | 3/2004 | Gibson et al. |
| 6,724,934 | B1 | 4/2004 | Lee et al. |
| 6,738,526 | B1 | 5/2004 | Betrisey et al. |
| 6,750,874 | B1 | 6/2004 | Kim |
| 6,870,523 | B1 | 3/2005 | Ben-David et al. |
| 6,885,380 | B1 | 4/2005 | Primerano et al. |
| 6,897,876 | B2 | 5/2005 | Murdoch et al. |
| 6,903,378 | B2 | 6/2005 | Cok |
| 6,937,217 | B2 | 8/2005 | Klompenhouwer et al. |
| 7,027,105 | B2 | 4/2006 | Lee et al. |
| 7,184,067 | B2 | 2/2007 | Miller et al. |
| 2001/0048764 | A1 | 12/2001 | Betrisey et al. |
| 2002/0063670 | A1 | 5/2002 | Yoshinaga et al. |
| 2003/0058466 | A1 | 3/2003 | Hoshuyama |
| 2003/0071775 | A1 | 4/2003 | Ohashi et al. |
| 2003/0112454 | A1 | 6/2003 | Woolfe et al. |
| 2003/0117457 | A1 | 6/2003 | Qiao |
| 2003/0128872 | A1 | 7/2003 | Lee et al. |
| 2003/0151694 | A1 | 8/2003 | Lee et al. |
| 2003/0179212 | A1 | 9/2003 | Matsushiro et al. |
| 2003/0214499 | A1 | 11/2003 | Ohsawa et al. |
| 2004/0021804 | A1 | 2/2004 | Hong et al. |
| 2004/0046725 | A1 | 3/2004 | Lee |
| 2004/0095521 | A1 | 5/2004 | Song et al. |
| 2004/0111435 | A1 | 6/2004 | Herbert et al. |
| 2004/0114046 | A1 | 6/2004 | Lee et al. |
| 2004/0222999 | A1 | 11/2004 | Choi et al. |
| 2004/0239813 | A1 | 12/2004 | Klompenhouwer |
| 2005/0024734 | A1 | 2/2005 | Richards et al. |
| 2005/0031199 | A1 | 2/2005 | Ben-Chorin et al. |
| 2005/0083341 | A1 | 4/2005 | Higgins et al. |
| 2005/0094871 | A1 | 5/2005 | Berns et al. |
| 2005/0105147 | A1 | 5/2005 | Gruzdev et al. |
| 2005/0152597 | A1 | 7/2005 | Spaulding et al. |
| 2005/0212728 | A1 | 9/2005 | Miller et al. |
| 2005/0219274 | A1 | 10/2005 | Yang et al. |
| 2005/0225562 | A1 | 10/2005 | Higgins et al. |
| 2006/0244686 | A1 | 11/2006 | Higgins et al. |
| 2008/0150958 | A1 | 6/2008 | Higgins |

FOREIGN PATENT DOCUMENTS

| | | | |
|---|---|---|---|
| JP | 6-261332 | | 9/1994 |
| JP | 08-202317 | | 8/1996 |
| WO | WO 00/42762 | | 7/2000 |
| WO | WO 01/37251 | A1 | 5/2001 |
| WO | WO 2004/040548 | | 5/2004 |
| WO | WO 2004/086128 | A1 | 10/2004 |
| WO | WO 2005/050296 | A1 | 6/2005 |
| WO | WO 2005/076257 | A2 | 8/2005 |
| WO | WO 2006/108083 | A2 | 10/2006 |
| WO | WO 2007/047537 | A2 | 4/2007 |
| WO | WO 2007/014340 | A2 | 12/2007 |
| WO | WO 2007/043463 | A2 | 12/2007 |

OTHER PUBLICATIONS

Betrisey, C., et al., Displaced Filtering for Patterned Displays, SID Symp. Digest 1999, pp. 296-299.

Brown Elliott, C., "Active Matrix Display . . . ", IDMC 2000, 185-189, Aug. 2000.

Brown Elliott, C., "Color Subpixel Rendering Projectors and Flat Panel Displays," SMPTE, Feb. 27-Mar. 1, 2003, Seattle, WA pp. 1-4.

Brown Elliott, C, "Co-Optimization of Color AMLCD Subpixel Architecture and Rendering Algorithms," SID 2002 Proceedings Paper, May 30, 2002 pp. 172-175.

Brown Elliott, C, " Development of the PenTile Matrix™ Color AMLCD Subpixel Architecture and Rendering Algorithms", SID 2003, Journal Article.

Brown Elliott, C, "New Pixel Layout for PenTile Matrix™ Architecture", IDMC 2002, pp. 115-117.

Brown Elliott, C, "Reducing Pixel Count Without Reducing Image Quality", Information Display Dec. 1999, vol. 1, pp. 22-25.

Klompenhouwer, Michiel, Subpixel Image Scaling for Color Matrix Displays, SID Symp. Digest, May 2002, pp. 176-179.

Michiel A. Klompenhouwer, Gerard de Haan, Subpixel image scaling for color matrix displays, Journal of the Society for Information Display, vol. 11, Issue 1, Mar. 2003, pp. 99-108.

Messing, Dean et al., Improved Display Resolution of Subsampled Colour Images Using Subpixel Addressing, IEEE ICIP 2002, vol. 1, pp. 625-628.

Messing, Dean et al., Subpixel Rendering on Non-Striped Colour Matrix Displays, 2003 International Conf on Image Processing, Sep. 2003, Barcelona, Spain, 4 pages.

Morovic, J., Gamut Mapping, in Digital Color Imaging Handbook, ed. G. Sharma, Boca Raton, FL: CRC Press, Dec. 2002, Chapter 10, pp. 635-682.

Murch, M., "Visual Perception Basics," SID Seminar, 1987, Tektronix Inc, Beaverton Oregon.

PCT International Search Report dated Jun. 21, 2006 for PCT/US05/01002 (U.S. Appl. No. 10/821,306).

PCT International Search Report dated Aug. 1, 2008 for PCT/US07/68885 (U.S. Appl. No. 60/891,668).

PCT International Search Report dated Jun. 11, 2008 for PCT/US07/69933 (U.S. Appl. No. 11/750,895).

Wandell, Brian A., Stanford University, "Fundamentals of Vision: Behavior . . . ," Jun. 12, 1994, Society for Information Display (SID) Short Course S-2, Fairmont Hotel, San Jose, California.

Werner, Ken, "OLEDS, OLEDS, Everywhere . . . ," Information Display, Sep. 2002, pp. 12-15.

* cited by examiner

Version 1

SYSTEMS AND METHODS FOR REDUCING DESATURATION OF IMAGES RENDERED ON HIGH BRIGHTNESS DISPLAYS

FIELD OF INVENTION

The present application is related to display systems, and more particularly, to techniques for mapping the input color image data from an input gamut to another so as to an output gamut to reduce desaturation of color images on high brightness displays.

BACKGROUND

Novel sub-pixel arrangements are disclosed for improving the cost/performance curves for image display devices in the following commonly owned United States Patents and Patent Applications including: (1) U.S. Pat. No. 6,903,754 ("the '754 patent") entitled "ARRANGEMENT OF COLOR PIXELS FOR FULL COLOR IMAGING DEVICES WITH SIMPLIFIED ADDRESSING;" (2) United States Patent Publication No. 2003/0128225 ("the '225 application") having application Ser. No. 10/278,353 and entitled "IMPROVEMENTS TO COLOR FLAT PANEL DISPLAY SUB-PIXEL ARRANGEMENTS AND LAYOUTS FOR SUB-PIXEL RENDERING WITH INCREASED MODULATION TRANSFER FUNCTION RESPONSE," filed Oct. 22, 2002; (3) United States Patent Publication No. 2003/0128179 ("the '179 application") having application Ser. No. 10/278,352 and entitled "IMPROVEMENTS TO COLOR FLAT PANEL DISPLAY SUB-PIXEL ARRANGEMENTS AND LAYOUTS FOR SUB-PIXEL RENDERING WITH SPLIT BLUE SUB-PIXELS," filed Oct. 22, 2002; (4) United States Patent Publication No. 2004/0051724 ("the '724 application") having application Ser. No. 10/243,094 and entitled "IMPROVED FOUR COLOR ARRANGEMENTS AND EMITTERS FOR SUB-PIXEL RENDERING," filed Sep. 13, 2002; (5) United States Patent Publication No. 2003/0117423 ("the '423 application") having application Ser. No. 10/278,328 and entitled "IMPROVEMENTS TO COLOR FLAT PANEL DISPLAY SUB-PIXEL ARRANGEMENTS AND LAYOUTS WITH REDUCED BLUE LUMINANCE WELL VISIBILITY," filed Oct. 22, 2002; (6) United States Patent Publication No. 2003/0090581 ("the '581 application") having application Ser. No. 10/278,393 and entitled "COLOR DISPLAY HAVING HORIZONTAL SUB-PIXEL ARRANGEMENTS AND LAYOUTS," filed Oct. 22, 2002; and (7) United States Patent Publication No. 2004/0080479 ("the '479 application") having application Ser. No. 10/347,001 and entitled "IMPROVED SUB-PIXEL ARRANGEMENTS FOR STRIPED DISPLAYS AND METHODS AND SYSTEMS FOR SUB-PIXEL RENDERING SAME," filed Jan. 16, 2003. Each of the aforementioned '225, '179, '724, '423, '581, and '479 published applications and U.S. Pat. No. 6,903,754 are hereby incorporated by reference herein in its entirety.

For certain subpixel repeating groups having an even number of subpixels in a horizontal direction, systems and techniques to affect improvements, e.g. polarity inversion schemes and other improvements, are disclosed in the following commonly owned United States patent documents: (1) United States Patent Publication No. 2004/0246280 ("the '280 application") having application Ser. No. 10/456,839 and entitled "IMAGE DEGRADATION CORRECTION IN NOVEL LIQUID CRYSTAL DISPLAYS"; (2) United States Patent Publication No. 2004/0246213 ("the '213 application") (U.S. patent application Ser. No. 10/455,925) entitled "DISPLAY PANEL HAVING CROSSOVER CONNECTIONS EFFECTING DOT INVERSION"; (3) U.S. Pat. No. 7,218,301 ("the '301 patent") having application Ser. No. 10/455,931 and entitled "SYSTEM AND METHOD OF PERFORMING DOT INVERSION WITH STANDARD DRIVERS AND BACKPLANE ON NOVEL DISPLAY PANEL LAYOUTS"; (4) U.S. Pat. No. 7,209,105 ("the '105 patent") having application Ser. No. 10/455,927 and entitled "SYSTEM AND METHOD FOR COMPENSATING FOR VISUAL EFFECTS UPON PANELS HAVING FIXED PATTERN NOISE WITH REDUCED QUANTIZATION ERROR"; (5) U.S. Pat. No. 7,187,353 ("the '353 patent") having application Ser. No. 10/456,806 entitled "DOT INVERSION ON NOVEL DISPLAY PANEL LAYOUTS WITH EXTRA DRIVERS"; (6) United States Patent Publication No. 2004/0246404 ("the '404 application") having application Ser. No. 10/456,838 and entitled "LIQUID CRYSTAL DISPLAY BACKPLANE LAYOUTS AND ADDRESSING FOR NON-STANDARD SUBPIXEL ARRANGEMENTS"; (7) United States Patent Publication No. 2005/0083277 ("the '277 application") having application Ser. No. 10/696,236 entitled "IMAGE DEGRADATION CORRECTION IN NOVEL LIQUID CRYSTAL DISPLAYS WITH SPLIT BLUE SUBPIXELS", filed Oct. 28, 2003; and (8) United States Patent Publication No. 2005/0212741 ("the '741 application") having application Ser. No. 10/807,604 and entitled "IMPROVED TRANSISTOR BACKPLANES FOR LIQUID CRYSTAL DISPLAYS COMPRISING DIFFERENT SIZED SUBPIXELS", filed Mar. 23, 2004. Each of the aforementioned '280, '213, '404, '277 and '741 published applications and the '301, 105, 353 patent are hereby incorporated by reference herein in its entirety.

These improvements are particularly pronounced when coupled with sub-pixel rendering (SPR) systems and methods further disclosed in the above-referenced U.S. Patent documents and in commonly owned United States Patents and Patent Applications: (1) U.S. Pat. No. 7,123,277 ("the '277 patent") having application Ser. No. 10/051,612 and entitled "CONVERSION OF A SUB-PIXEL FORMAT DATA TO ANOTHER SUB-PIXEL DATA FORMAT," filed Jan. 16, 2002; (2) U.S. Pat. No. 7,221,381 ("the '381 patent") having application Ser. No. 10/150,355 entitled "METHODS AND SYSTEMS FOR SUB-PIXEL RENDERING WITH GAMMA ADJUSTMENT," filed May 17, 2002; (3) U.S. Pat. No. 7,184,066 ("the '066 patent") having application Ser. No. 10/215,843 and entitled "METHODS AND SYSTEMS FOR SUB-PIXEL RENDERING WITH ADAPTIVE FILTERING," filed Aug. 8, 2002; (4) United States Publication No. 2004/0196302 ("the '302 application") having application Ser. No. 10/379,767 and entitled "SYSTEMS AND METHODS FOR TEMPORAL SUB-PIXEL RENDERING OF IMAGE DATA" filed Mar. 4, 2003; (5) U.S. Pat. No. 7,167,186 ("the '186 patent") having application Ser. No. 10/379,765 and entitled "SYSTEMS AND METHODS FOR MOTION ADAPTIVE FILTERING," filed Mar. 4, 2003; (6) U.S. Pat. No. 6,917,368 ("the '368 patent") entitled "SUB-PIXEL RENDERING SYSTEM AND METHOD FOR IMPROVED DISPLAY VIEWING ANGLES"; and (7) United States Patent Publication No. 2004/0196297 ("the '297 application") having application Ser. No. 10/409,413 and entitled "IMAGE DATA SET WITH EMBEDDED PRE-SUBPIXEL RENDERED IMAGE" filed Apr. 7, 2003. Each of the aforementioned '302, and '297 applications and the '277, '381, '066, '186 and the '368 patents are hereby incorporated by reference herein in its entirety.

Improvements in gamut conversion and mapping are disclosed in commonly owned United States Patents and co-pending United States Patent Applications: (1) U.S. Pat. No. 6,980,219 ("the '219 patent") entitled "HUE ANGLE CALCULATION SYSTEM AND METHODS"; (2) United States Patent Publication No. 2005/0083341 ("the '341 application") having application Ser. No. 10/691,377 and entitled "METHOD AND APPARATUS FOR CONVERTING FROM SOURCE COLOR SPACE TO TARGET COLOR SPACE", filed Oct. 21, 2003; (3) United States Patent Publication No. 2005/0083352 ("the '352 application") having application Ser. No. 10/691,396 and entitled "METHOD AND APPARATUS FOR CONVERTING FROM A SOURCE COLOR SPACE TO A TARGET COLOR SPACE", filed Oct. 21, 2003; and (4) U.S. Pat. No. 7,176,935 ("the '935 patent") having application Ser. No. 10/690,716 and entitled "GAMUT CONVERSION SYSTEM AND METHODS" filed Oct. 21, 2003. Each of the aforementioned '341, and '352 applications and the '219 and '935 patents are hereby incorporated by reference herein in its entirety.

Additional advantages have been described in (1) U.S. Pat. No. 7,084,923 ("the '923 patent") having application Ser. No. 10/696,235 and entitled "DISPLAY SYSTEM HAVING IMPROVED MULTIPLE MODES FOR DISPLAYING IMAGE DATA FROM MULTIPLE INPUT SOURCE FORMATS", filed Oct. 28, 2003; and in (2) United States Patent Publication No. 2005/0088385 ("the '385 application") having application Ser. No. 10/696,026 and entitled "SYSTEM AND METHOD FOR PERFORMING IMAGE RECONSTRUCTION AND SUBPIXEL RENDERING TO EFFECT SCALING FOR MULTI-MODE DISPLAY" filed Oct. 28, 2003, each of which is hereby incorporated herein by reference in its entirety.

Additionally, each of these co-owned and co-pending applications is herein incorporated by reference in its entirety: (1) United States Patent Publication No. 2005/0225548 ("the '548 application") having application Ser. No. 10/821,387 and entitled "SYSTEM AND METHOD FOR IMPROVING SUB-PIXEL RENDERING OF IMAGE DATA IN NON-STRIPED DISPLAY SYSTEMS"; (2) United States Patent Publication No. 2005/0225561 ("the '561 application") having application Ser. No. 10/821,386 and entitled "SYSTEMS AND METHODS FOR SELECTING A WHITE POINT FOR IMAGE DISPLAYS"; (3) United States Patent Publication No. 2005/0225574 ("the '574 application") and United States Patent Publication No. 2005/0225575 ("the '575 application") having application Ser. Nos. 10/821,353 and 10/961,506 respectively, and both entitled "NOVEL SUBPIXEL LAYOUTS AND ARRANGEMENTS FOR HIGH BRIGHTNESS DISPLAYS"; (4) United States Patent Publication No. 2005/0225562 ("the '562 application") having application Ser. No. 10/821,306 and entitled "SYSTEMS AND METHODS FOR IMPROVED GAMUT MAPPING FROM ONE IMAGE DATA SET TO ANOTHER"; (5) U.S. Pat. No. 7,248,268 ("the '268 patent") having application Ser. No. 10/821,388 and entitled "IMPROVED SUBPIXEL RENDERING FILTERS FOR HIGH BRIGHTNESS SUBPIXEL LAYOUTS"; and (6) United States Patent Publication No. 2005/0276502 ("the '502 application") having application Ser. No. 10/866,447 and entitled "INCREASING GAMMA ACCURACY IN QUANTIZED DISPLAY SYSTEMS."

Additional improvements to, and embodiments of, display systems and methods of operation thereof are described in: (1) Patent Cooperation Treaty (PCT) Application No. PCT/US 06/12768, entitled "EFFICIENT MEMORY STRUCTURE FOR DISPLAY SYSTEM WITH NOVEL SUBPIXEL STRUCTURES" filed Apr. 4, 2006, and published in the United States as United States Patent Application Publication 2008/0170083; (2) Patent Cooperation Treaty (PCT) Application No. PCT/US 06/12766, entitled "SYSTEMS AND METHODS FOR IMPLEMENTING LOW-COST GAMUT MAPPING ALGORITHMS" filed Apr. 4, 2006, and published in the United States as United States Patent Application Publication 2008/0150958; (3) U.S. patent application Ser. No. 11/278,675, entitled "SYSTEMS AND METHODS FOR IMPLEMENTING IMPROVED GAMUT MAPPING ALGORITHMS" filed Apr. 4, 2006, and published as United States Patent Application Publication 2006/0244686; (4) Patent Cooperation Treaty (PCT) Application No. PCT/US 06/12521, entitled "PRE-SUBPIXEL RENDERED IMAGE PROCESSING IN DISPLAY SYSTEMS" filed Apr. 4, 2006, and published in the United States as United States Patent Application Publication 2008/0186325; and (5) Patent Cooperation Treaty (PCT) Application No. PCT/US 06/19657, entitled "MULTIPRIMARY COLOR SUBPIXEL RENDERING WITH METAMERIC FILTERING" filed on May 19, 2006 and published in the United States as United States Patent Application Publication 2009/0058873 (referred to below as the "Metamer Filtering application".) Each of these co-owned applications is also herein incorporated by reference in their entirety.

BRIEF DESCRIPTION OF THE DRAWINGS

The organization and methods of operation of the display systems and techniques disclosed herein are best understood from the following description of several illustrated embodiments when read in connection with the following drawings in which the same reference numbers are used throughout the drawings to refer to the same or like parts.

TECHNICAL FIELD

In one embodiment of the display system, the display system comprises an image pipeline that accepts input color image data of one color gamut to be rendered on a display having high brightness subpixel layouts. In one embodiment, the system comprises a boost function that maps the input color data onto another color gamut that boosts the luminance of colors that might appear dark if rendered against a white or very light background.

DETAILED DESCRIPTION

High brightness displays are becoming more used—particularly in cellphones and other handheld devices—for their ability to render bright images while reducing power consumption, as compared to conventional RGB stripe displays. High brightness displays are those that may have a "white" (or unfiltered) subpixel (e.g. RGBW) or other multiprimary colors (e.g. RGBXW, where the "X" could be cyan, magenta or yellow or any other colored subpixel). These present methods may well work with any RGBX display—where X would tend to be a bright (e.g. high luminance) colored subpixel. Several high brightness displays are disclosed in the '575 application incorporated by reference above.

With any RGBW or multiprimary system (including not only the novel ones described in the '575 application but also in conventional ones, like RGBW quad systems), the problem of "simultaneous contrast" is an issue that arises with rendering images having pure (or highly saturated) colors rendered against a white or very light background. In fact, such saturated colors would tend to look dark against such a white or light background. This is especially evident for yellow, cyan and possibly magenta—which are bright mixed colors. This discussion provides a possible solution to the problem of displaying these bright mixed colors on a display with RGBW (or "X") primary colors. In general the techniques disclosed herein examine the input color image data for "major colors" and a "minor color" to determine which section of the color space an input color image data value is located. For example, if the input color image data is specified as RGB data, and the R and G data values are high and the B value is low, then the color is near yellow; if R and B are high and G is low, then the color is near magenta; and if B and G are high and R is low, then the color is near cyan. When such a condition is met, the technique computes a substitute color value for the low valued color data value. In effect, the technique seeks to adjust the level of the low valued color, referred to as "boost," in a manner that allows for smooth color transitions (i.e., the "boost" decreases smoothly) as the minor color increases or as the major colors decrease.

Figure 1:
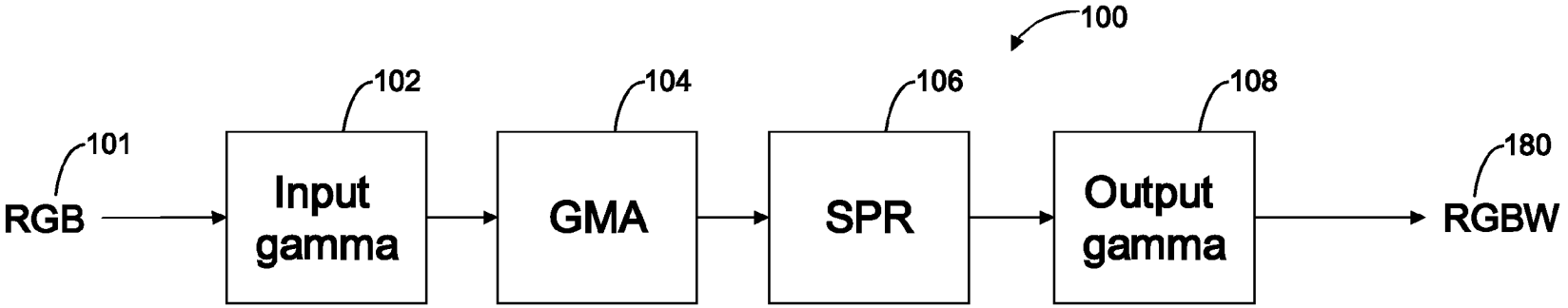
Prior Art FIG. 1
FIG. 1 shows a conventional image processing pipeline.

FIG. 1 shows a conventional image processing pipeline 100 that comprises an input gamma block 102, a gamut mapping algorithm (GMA) block 104, a subpixel rendering block 106 and an output gamma block 108. This system inputs RGB image data 101 and effectively maps the input data from a RGB gamut to a RGBW gamut. The RGBW image data 180 is output to a display (not shown) having an RGBW subpixel layout. The RGBW layout of the display could be a conventional one (such as RGBW quad) or one of the novel ones disclosed in the '575 application.

Figure 2A:
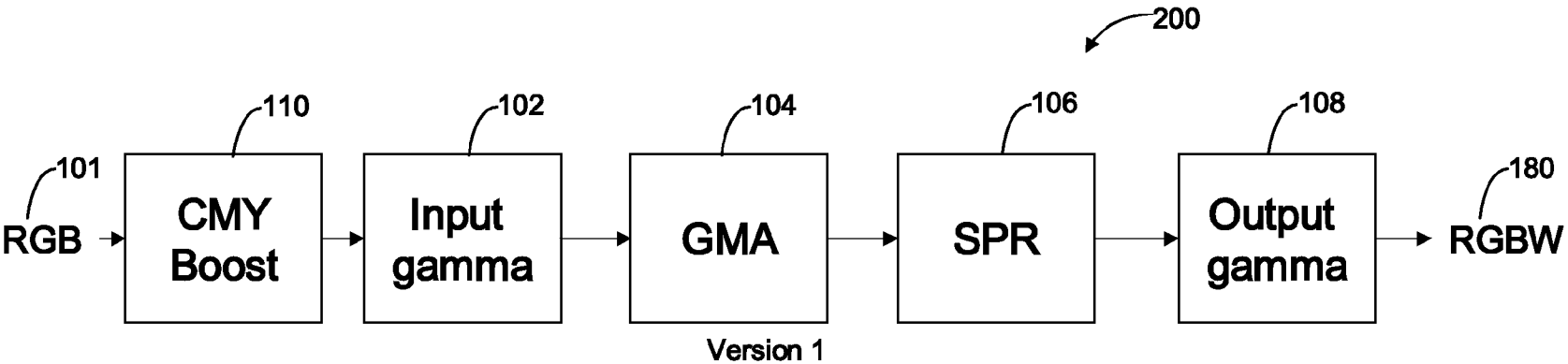
FIGS. 2A-2C depict possible embodiments of a present system made in accordance with the principles of the present invention.
Figure 2B:
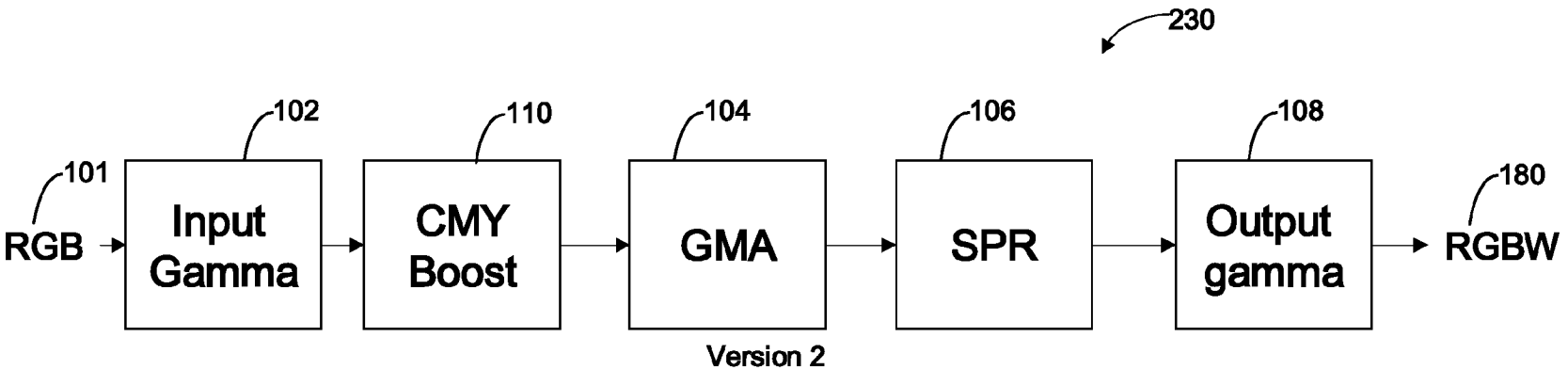
Figure 2C:
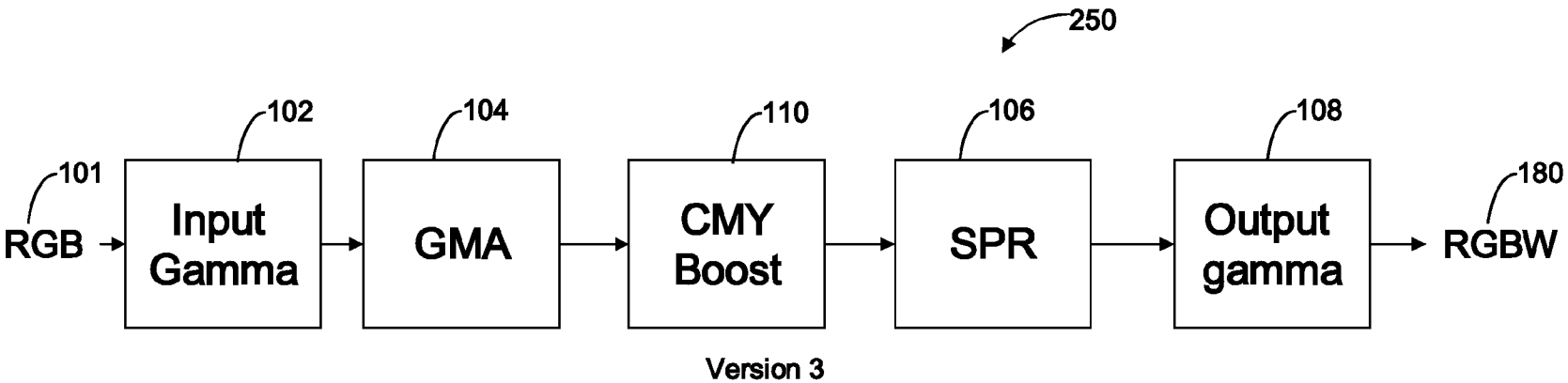

FIGS. 2A through 2C depict possible embodiments 200, 230 and 250 of a present system made in accordance with the principles of the present invention. In addition to the blocks already disclosed, CMY boost block 110 (as will be discussed below) is shown in various possible configurations. CMY boost block comprises the techniques of the present system to address, among other issues, the issue of simultaneous contrast and/or darkening of saturated colors against a light or white background. It will be appreciated that, although block 110 is labeled "CMY Boost", the colors cyan, magenta and yellow (specified as CMY in FIGS. 2A-2C) are merely exemplary and any other set of suitable colors may advantageously use the techniques discussed herein.

As may be seen in FIGS. 2A through 2C, CMY boost block 110 may be placed in many possible locations within an image pipeline. In these embodiments, the techniques of boost block 110 may be placed before input gamma block 102, immediately after GMA block 104. Of course, CMY boost block 110 can be placed in other parts of the image processing pipeline, including before or after the output gamma block 108.

Figure 3:
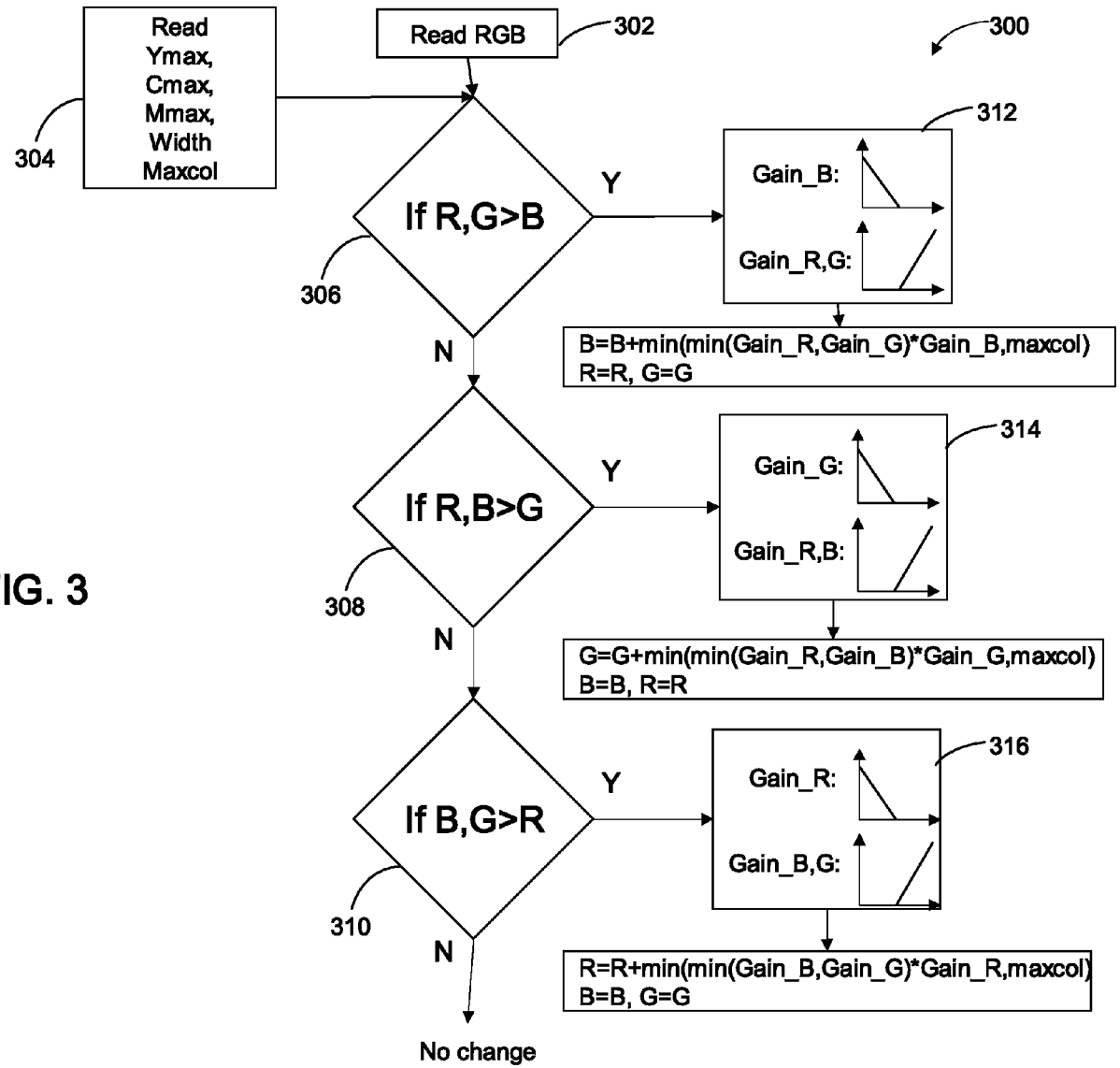
FIG. 3 depicts a basic flowchart of one embodiment of the gamut processing as made in accordance the present system.

FIG. 3 depicts a basic flowchart 300 of the processing that occurs in CMY boost block 110. At steps 302 and 304, the system reads in both the input data and various operating parameters respectively. For merely one embodiment, boost block 110 is shown as processing red, green and blue image data to affect primarily Cyan (C), Magenta (M) and Yellow (Y). Of course, it will be appreciated the techniques of the present system could be made to work as well with other mixed color points that suffer simultaneous contrast issues.

Continuing with the present example, the following parameters are read in at step 304—Ymax, Cmax, Mmax, Width and Maxcol. Parameters Ymax, Cmax, Mmax and width determine the slope and intercept of the gain curves, as shown in FIG. 3. Maxcol is the total number of discrete gray values for a given color—e.g. 255 for 8 bit date, which exemplary value can be normalized to be 255/(255) or 1.0 in normalized unit terms.

With continued reference to FIG. 3, the system then applies a set of conditions 306, 308 and 310. Each of these conditions tests to see if there are mixed colors that might suffer simultaneous contrast. Step 306 tests IF R,G>B (i.e. is the color primarily yellow), step 308 tests IF R,B>G (i.e. is the color primarily magenta) and step 310 tests if B, G>R (i.e. is the color primarily cyan). If none of the three tests is satisfied, processing proceeds down the "N" path, and no boost is made to the input color. If, however, one of the tests is satisfied, then an appropriate change to the input image color data is made according to steps 312, 314 or 316 respectively. It will be appreciated by a person of skill in the art that various implementation choices are available to accomplish the processing in FIG. 3. For example, the input RGB data values could be sorted first to directly find which of the tests 306, 308 and 310 is the appropriate test to apply.

Each step 312, 314 and 316 show gain curves and an exemplary formula for processing the data. In general, the processing in the present system as shown in FIG. 3 selectively desaturates mixed colors (e.g. C, M and/or Y) with a prescribed function in such a way as to not introduce step artifacts. In the case of example above (i.e. three mixed colors C, M or Y), three functions may be developed that depend on the location of the "boost" function (i.e. C, M or Y respectively). If there are more mixed colors to be boosted, then other functions may appropriately be added.

Figure 9B:
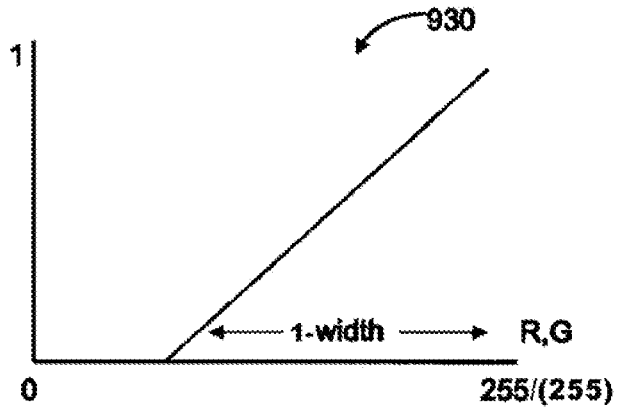
FIGS. 9A and 9B show merely one possible relation between normalized Width and the normalized gain curves for one exemplary color boost.
Figure 9A:
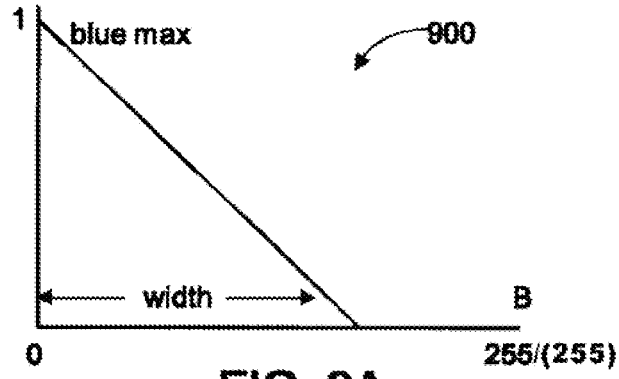
Figure 10:
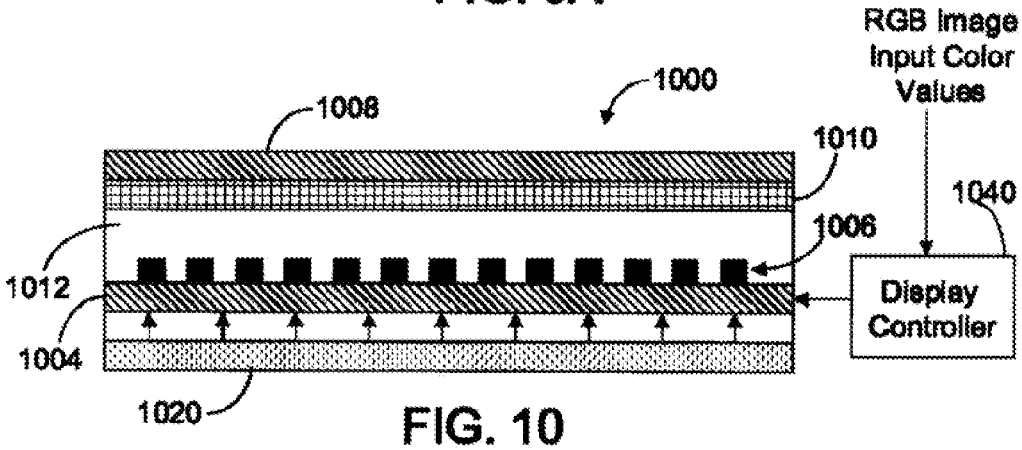
FIG. 10 is a block diagram of a flat panel display system in which the techniques and methods disclosed herein may be implemented.

As noted above, the processing looks for "major colors" and "minor color" to determine which section of color space an input color image data value (e.g., an RGB value) is located. For example, if R and G are high and B is low, then the color is near yellow; if R and B are high and G is low, then the color is near magenta; and if B and G are high and R is low, then the color is near cyan. If such a condition is met, then the system seeks to adjust the level of "boost" of the low valued color, so that the boost decreases smoothly as the minor color increases or as the major colors decrease. As shown in FIG. 3, if R and G are high and B is low, a possible function to boost for blue (B) is computed as:

$$B=B+\min(\min(\text{Gain_}R,\text{Gain_}G)*\text{Gain_}B,\text{maxcol})$$

and R and G remain the same. If R and B are high and G is low, a possible boost for green (G) is computed as:

$$G=G+\min(\min(\text{Gain_}R,\text{Gain_}B)*\text{Gain_}G,\text{maxcol})$$

and R and B remain the same. If B and G are high and R is low, a possible boost for red (R) is computed as:

$$R=R+\min(\min(\text{Gain_}B,\text{Gain_}G)*\text{Gain_}R,\text{maxcol}$$

and B and G remain the same. Various functions may suffice for such boost processing—i.e. to decrease boost—including a linear drop, as either minor color increases or major colors decrease. The slope of the function will determine how localized the boost is. For exemplary purposes, charts 900 and 1000 in FIGS. 9A-9B and 10 depict merely one possible relationship between the normalized parameter Width (e.g., normalized relative to the 255/(255) MaxCol value) and the normalized gain curves for the minor color gain (e.g. blue) and major color gain (e.g. red and green), respectively, in "yellow" boost—other colors may proceed similarly.

Table 1 provides a possible embodiment of computing boost functions that work for our exemplary mixed colors of yellow, cyan and magenta, respectively:

TABLE 1

EXAMPLE BOOST FUNCTIONS

```
Function boost__y(red, green, blue, redmax, greenmax, bluemax, width,
colors)
    maxcol = colors
    gainblue = Max((bluemax / width) * (width − blue / maxcol), 0)
    gainred = Max((1 / (1 − width)) * (red / maxcol − width), 0)
    gaingreen = Max((1 / (1 − width)) * (green / maxcol − width), 0)
    boost__y = Min((Int((Min(gainred, gaingreen)) * gainblue)), maxcol)
End Function
Function boost__c(red, green, blue, redmax, greenmax, bluemax, width,
colors)
    maxcol = colors
    gainred = Max((redmax / width) * (width − red / maxcol), 0)
    gainblue = Max((1 / (1 − width)) * (blue / maxcol − width), 0)
    gaingreen = Max((1 / (1 − width)) * (green / maxcol − width), 0)
    boost__c = Min((Int((Min(gainblue, gaingreen)) * gainred)), maxcol)
End Function
Function boost__m(red, green, blue, redmax, greenmax, bluemax, width,
colors)
    maxcol = colors
    gaingreen = Max((greenmax / width) * (width − green / maxcol), 0)
    gainblue = Max((1 / (1 − width)) * (blue / maxcol − width), 0)
    gainred = Max((1 / (1 − width)) * (red / maxcol − width), 0)
    boost__m = Min((Int((Min(gainblue, gainred)) * gaingreen)), maxcol)
End Function
```

In the above example, the functions used are a linear ramp with a max value of redmax (for cyan boost), greenmax (for magenta boost), and bluemax (for yellow boost). "Width" is a value that determines the intercept of the boost function at the y axis. These equations create a "gain" function for each color, which is used to modify the minor color (or white).

For further exposition of the present example, the yellow boost may be considered, for example. The first step is to determine which major color is smaller. In one embodiment, this will be used in the gain function since it may be desirable to have the gain diminish as color moves away from 255,255, n. An alternate embodiment is to take the average of two gain functions (one for R and one for G). For such a "middle color", it may be desirable to calculate the gain.

For minor color (in this case, blue), its gain may then be calculated. It should be noted that as blue increases in the image (i.e. color moves towards white), it may be desirable to have the gain decrease, as boost may no longer be needed.

A next step is to multiply the gains together and add to the blue value. In this example, the "width" represents the range that boost will be applied. This width could be the same for all colors, or it could be adjusted color by color. Additionally, it should be noted that the linear curve can be replaced with a different function to better smooth out the transitions.

In effect, the technique computes a substitute color data value for the minimum color data value. The substitute color data value is computed as a function of a relationship between slopes of first and second gain curves. The first gain curve indicates a function of color adjustment values for the primary color indicated by the minimum color data value, and the second gain curve indicates a function of color adjustment values for the other primary colors.

Figure 4B:
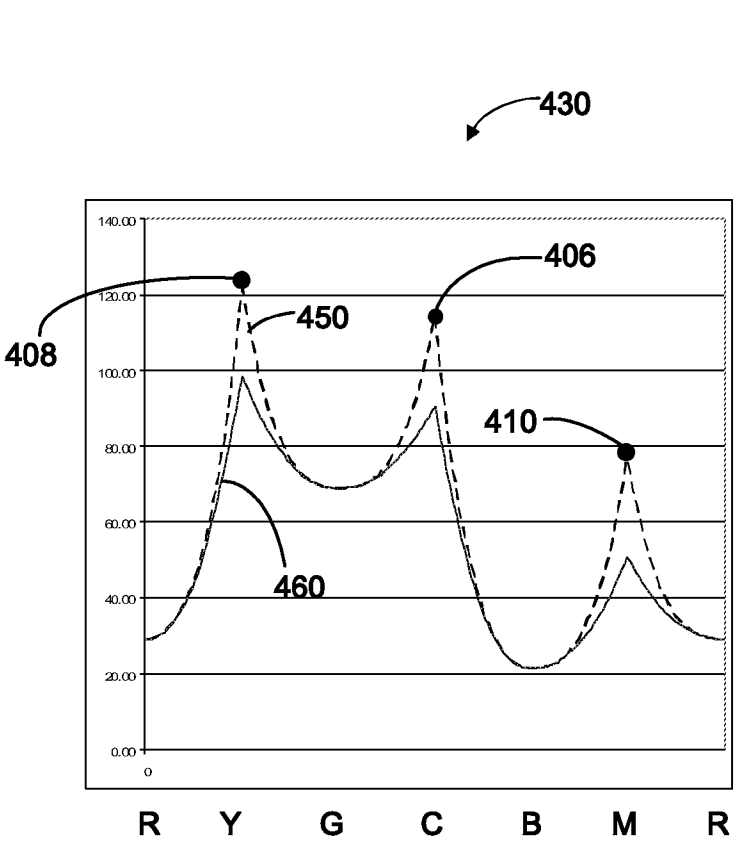
FIGS. 4A and 4B, 5A and 5B and 6A and 6B depict some alternative embodiments of the boosting functions of the present system.
Figure 4A:
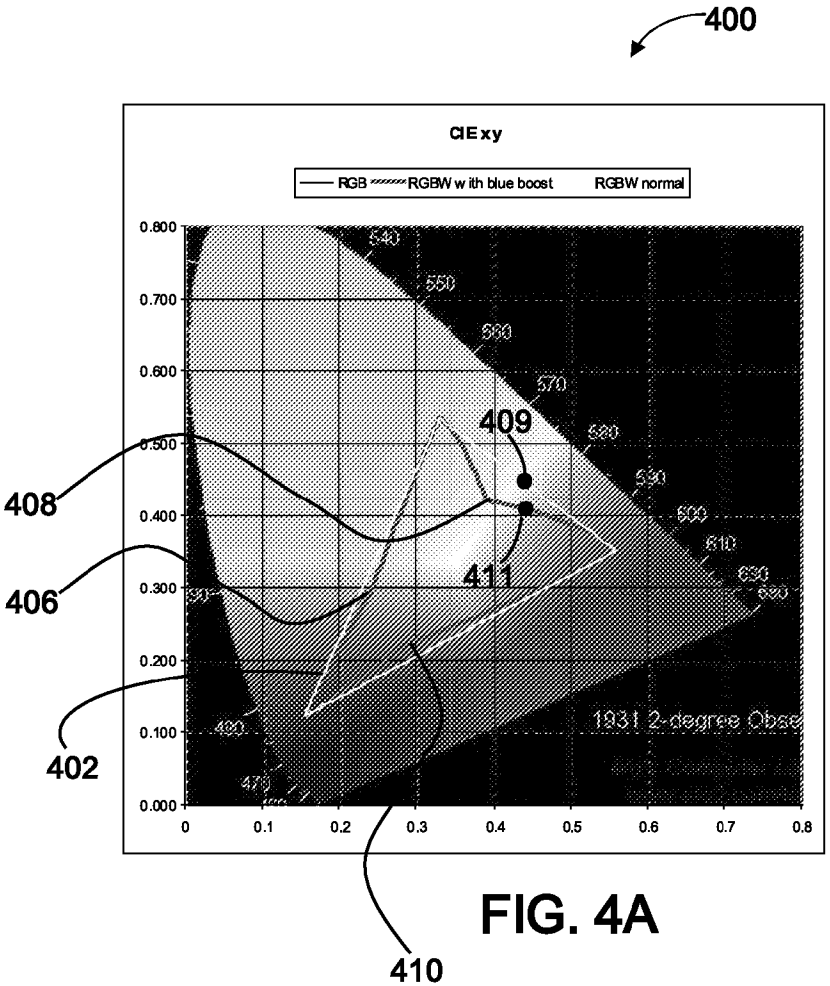

FIGS. 4A-4B, 5A-5B and 6A-6B depict some alternative embodiments of the boosting functions (for our CMY examples) above. FIG. 4A shows a color gamut chart 400 in 1931 CIE xy color space (or any other suitable space). Within the color gamut space, there is a triangular region 402 that depicts a color gamut of the input RGB color space. With one set of exemplary boost functions operating, this color gamut may be altered or mapped to another color gamut that includes the points 406, 408 and 410 which respectively depict the Cyan, Yellow and Magenta boosts. As may be seen, if an input color point is near—e.g. yellow at a point 409, then the present system would "boost" or map that color point onto point 411 (e.g. in the direction of 408).

Chart 430 in FIG. 4B shows a mapping of the luminance (along the Y axis) with the color points of the gamut running along the X axis. Curve 460 depicts the luminance curve of region 402 (I.e., color gamut of the input RGB color space), while curve 450 depicts the luminance curve of region 404 (i.e., the color gamut of the "boosted" RGB color space). Points 406, 408, and 410 are shown on FIG. 4B. FIG. 4B depicts graphically the boost function in luminance as input color points get closer to points that get remapped to points 406, 408, and 410.

Figure 5B:
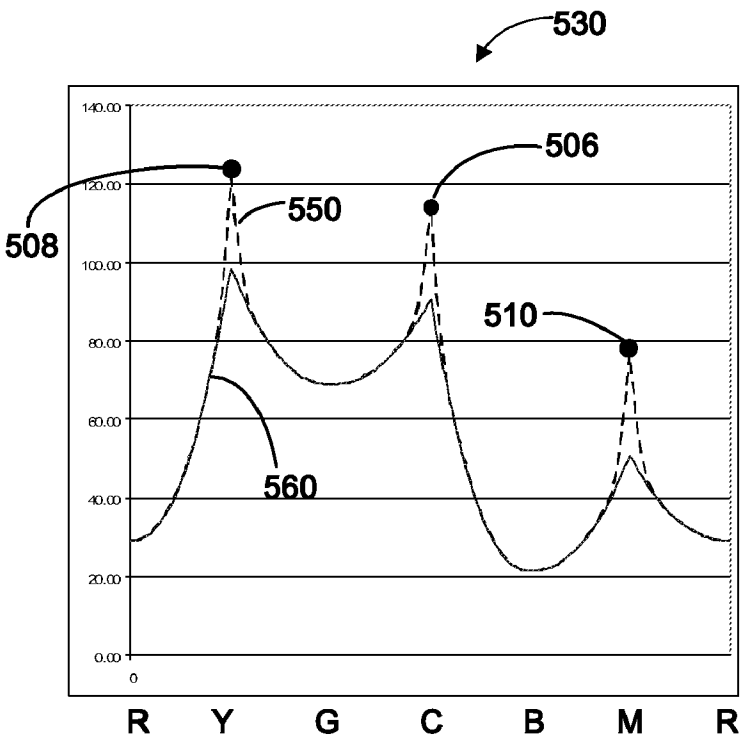
Figure 5A:
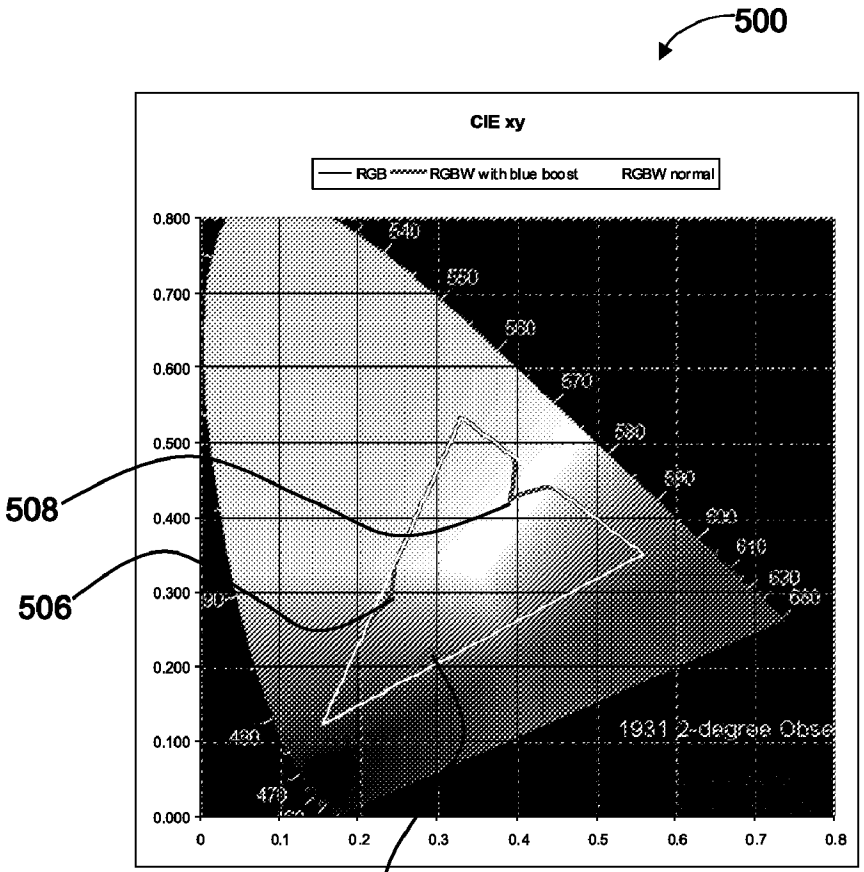
Figure 6B:
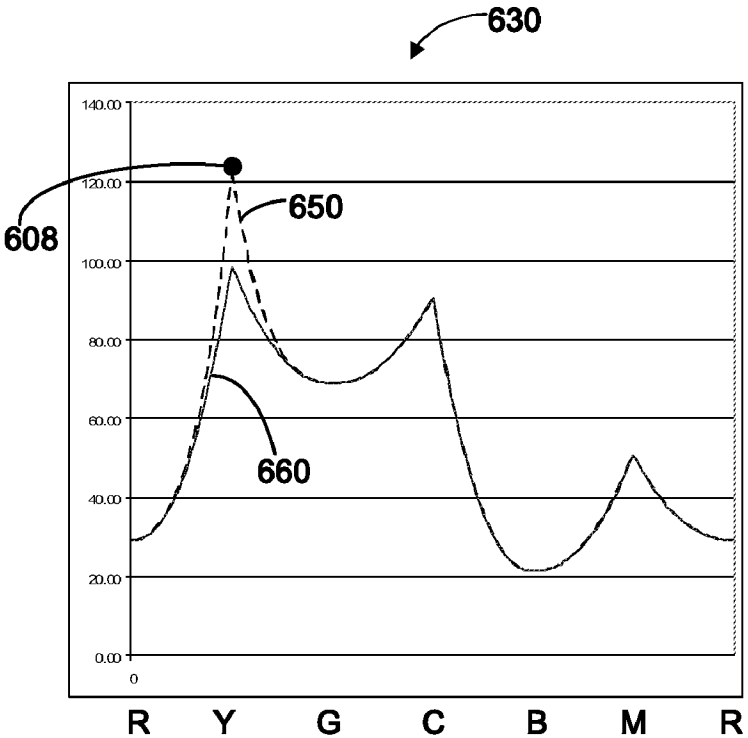
Figure 6A:
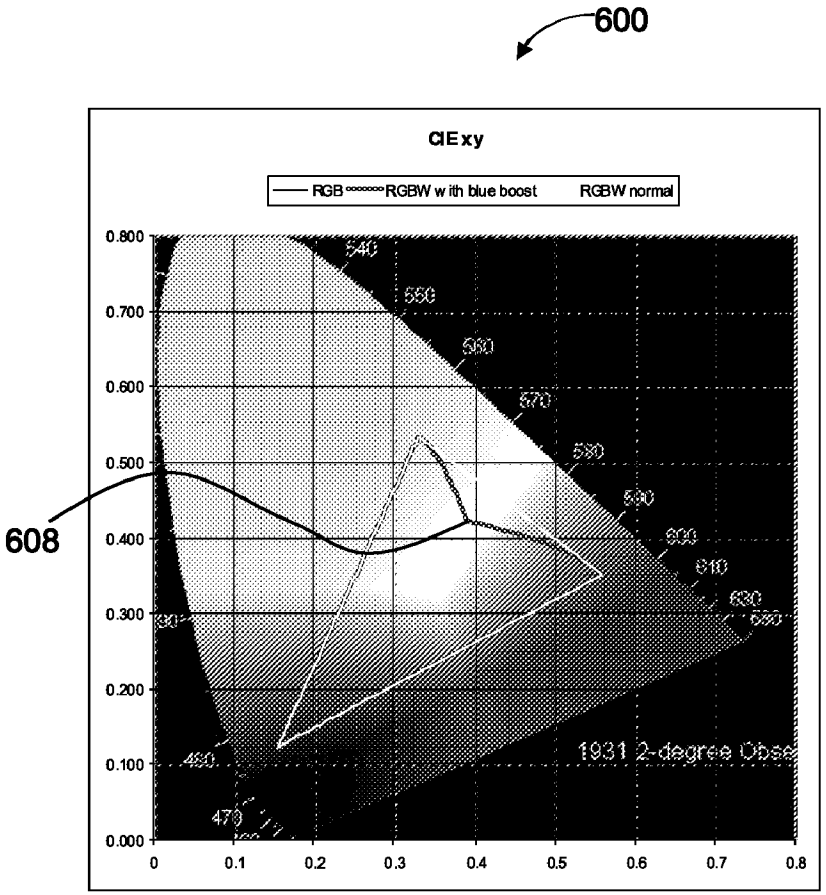
Figure 7:
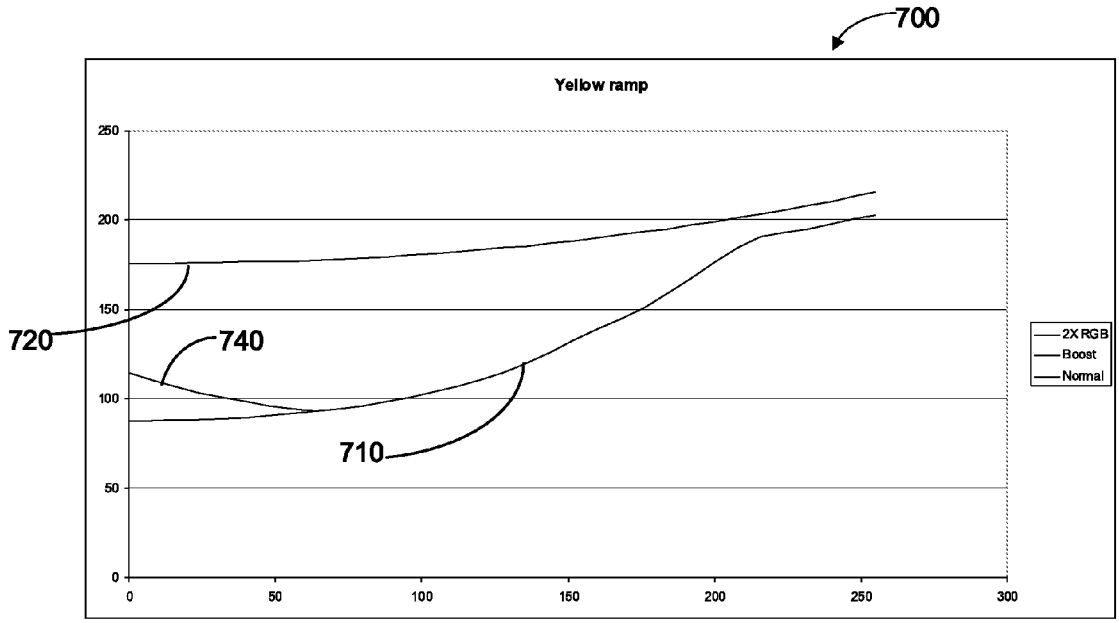
FIGS. 7 and 8 show one example of an inflection point that might occur if the boost is too localized to mixed colors and one example of how to alter certain parameters to reduce the inflection.

FIGS. 5A-5B are analogous to FIGS. 4A-4B; but show that the boost functions could be differently peaked that in FIGS. 4A-4B. In the case of FIGS. 5A-5B, Chart 530 of FIG. 5B shows that the boost functions may be more narrowly peaked. Alternatively, of course, the boost functions may be spread out. FIGS. 6A-6B show that the present system could be designed to operate on less than all possible mixed colors. In this case, chart 630 shows that only yellow is boosted.

Those of skill in the art would appreciate that the color gamut regions—either input or output—need not assume any particular geometric area (e.g. triangular) as shown in FIGS. 4A, 5A or 6A. In fact, such regions reflect the natural shape that the systems' primary colors determine, and so could take on a variety of shapes. For example, if the input gamut reflects a four color primary system, the input color gamut might be a four-sided area. The output color gamut can be any possible geometric shape that is preferably natural to the output image data.

As was mentioned above, the boost block or function may be placed in the image procession pipeline at many various locations. If placed before the input gamma LUT, then the boost processing could evaluate which color region the RGB value is located. If the RGB value is near yellow, cyan, or magenta, then the "minor color" is increased in value.

If the boost processing is located in the GMA, then the boost processing could evaluate which color region the RGB value is located, but it uses the RGB values after the input LUT (but perhaps before the GMA). If the color is located near yellow, cyan, or magenta, then the white subpixel value could be increased in value.

If the boost processing is located after the output gamma LUT, then the boost processing could evaluate which color region the RGB value is located but it increases the white subpixel value after the output LUT. This may work well for broad colors, but might cause some fuzzing out sharp lines since the data has already passed through the SPR.

If the boost function is inside the GMA, then the sharpness of the color transition may be increased because colors are linearly added inside the gamma pipeline.

In yet another embodiment, an adjustment may be made to prevent any possible inversions of luminance through the addition of the boost function. For one example, this might happen if the boost is too localized to mixed color points i.e. yellow.

Figure 8:
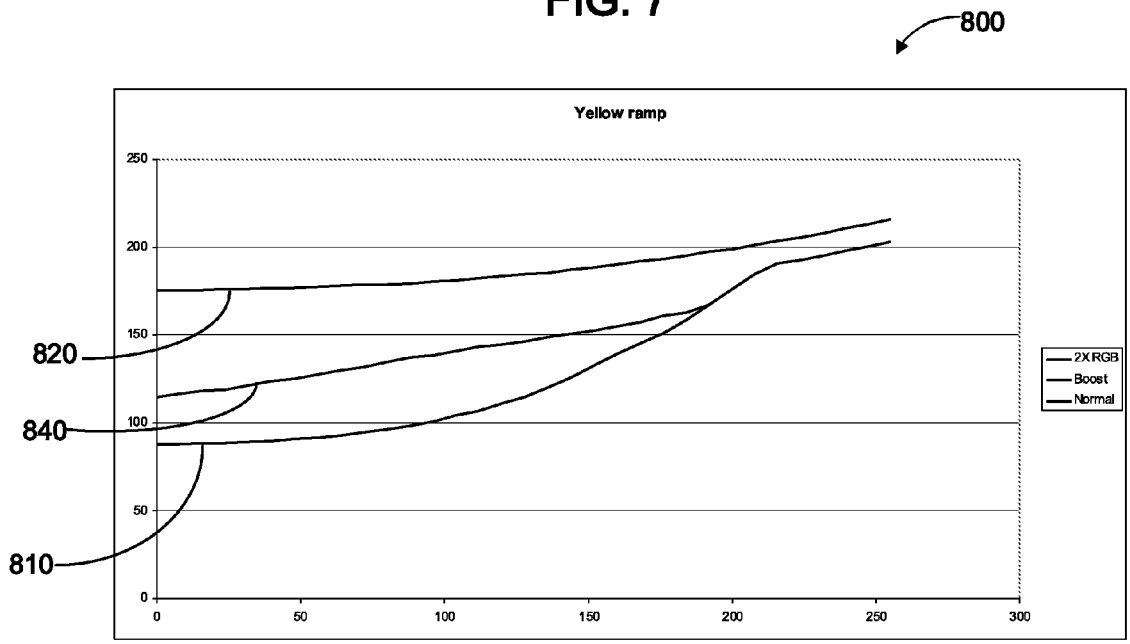

12FIG. 7 depicts a graph 700 of some ramps of yellow to white. The upper line 720 is a target luminance ramp (e.g. 2 times RGB ramp). Line 710 is luminance with no boost. Line 740 is luminance with boost set at max=128 and width=25%. It should be noted that the luminance has an inflection point 750. If width is set to 75%, however, this inflection point may be eliminated, as shown in the chart 800 in FIG. 8.

FIG. 10 is a simplified (and not to scale) block diagram of a flat panel display system 1000 (such as, for example, a liquid crystal display (LCD)) in which any one of the embodiments disclosed herein may be implemented. LCD 1000 includes liquid crystal material 1012 disposed between glass substrates 1004 and 1008. Substrate 1004 includes TFT array 1006 for addressing the individual pixel elements of LCD 1000. Substrate 1008 includes color filter 1010 on which any one of the subpixel repeating groups illustrated in the '575 application referenced above, and in various other ones of the co-owned patent applications, may be disposed. Display controller 1040 processes the RGB image input color values according to the image processing pipeline shown in any one of FIGS. 2A, 2B or 2C, and in accordance with the functions described in FIG. 3. A person of skill in the art will appreciate that the techniques disclosed herein may be implemented on a wide variety of display systems and devices in addition to the one generally described in FIG. 10.

While the techniques and implementations have been described with reference to exemplary embodiments, it will be understood by those skilled in the art that various changes may be made and equivalents may be substituted for elements thereof without departing from the scope of the appended claims. In addition, many modifications may be made to adapt a particular situation or material to the teachings without departing from the essential scope thereof. Therefore, the particular embodiments, implementations and techniques disclosed herein, some of which indicate the best mode contemplated for carrying out these embodiments, implementations and techniques, are not intended to limit the scope of the appended claims.

What is claimed is:

1. An image processing method comprising:

receiving input color image data representing an initial color of a to-be-rendered pixel where the received color image data comprises at least first, second and third primary color data values defining an initial to-be-rendered color of the pixel;

determining if the initial to-be-rendered color has a minimum one among the received at least a first, second and third primary color data values and larger others of the primary color data values and, if so, identifying the minimum one color data value of said received at least first, second and third primary color data values; and computing a substitute and higher color data value for said minimum one color data value;

wherein the image processing method computes said substitute and higher color data value as a function of two or more variable gain values, where a first of the variable gain values decreases as the value of the identified minimum one color data value increases and where a second of the variable gain values increases as the value of a corresponding received and larger color data value of a corresponding one of the larger others of the primary color data values increases.

2. The method as recited in claim 1 wherein a mixed color is comprised of color data values that are not equal to or less than the minimum one color data value.

3. The method as recited in claim 2 wherein said first, second and third primary colors data values are red, green and blue respectively.

4. The method as recited in claim 3 wherein said mixed color comprises one of a group, said group comprising near-to or at cyan, near-to or at magenta and near-to or at yellow.

5. The method as recited in claim 1 wherein:

the initial to-be-rendered color is to-be-rendered adjacent to one or more other pixels that define a relatively bright background whereby the initial to-be-rendered color will be perceived as overly dark relative to the bright background, where said overly dark condition is called a simultaneous contrast condition; and said boosting of the identified minimum one color data value reduces the amount of simultaneous contrast of said mixed color.

6. A display system comprising:

a receiver configured for receiving an input image data signal representing initial and respective colors of a to-be-rendered pixels;

a display, said display having a display area populated by a subpixel repeating group, said repeating group comprising at least one high brightness light emitter that can output a light of relatively high brightness;

a gamut mapping unit, said gamut mapping unit being configured to map said input image data onto high brightness image data, said high brightness image data being associated with said subpixel repeating group comprising said at least one high brightness light emitter; and a boost unit, said boost unit being configured to carry out a selective brightness boosting process for certain ones of to-be-rendered color spots, the selective brightness boosting process comprising:

determining if an initial to-be-rendered color spot is a mixed color spot having a minimum one among at least three primary color data values and if so identifying the minimum one color data value;

computing a substitute and higher color data value for said minimum one color data value, wherein the computed substitute and higher color data value is a function of two or more variable gain values, where a first of the variable gain values decreases as the value of the identified minimum one color data value increases and where a second of the variable gain values increases as the value of a corresponding other and larger color data value of a corresponding color spot increases.

7. The display system as recited in claim 6 wherein said mixed color comprises at least one of a group, said group comprising near-to or at cyan, near-to or at magenta and near-to or at yellow.

8. The display system as recited in claim 6 wherein said at least one high brightness light emitter is configured to emit a light that is one of a group, said group comprising: white, cyan, yellow, magenta.

* * * * *